US008523133B2

(12) United States Patent
McKellar

(10) Patent No.: US 8,523,133 B2
(45) Date of Patent: Sep. 3, 2013

(54) COLLAPSIBLE BOOK HOLDER

(76) Inventor: Bernard R. McKellar, Beavercreek, OH (US)

( * ) Notice: Subject to any disclaimer, the term of this patent is extended or adjusted under 35 U.S.C. 154(b) by 0 days.

(21) Appl. No.: 13/323,234

(22) Filed: Dec. 12, 2011

(65) Prior Publication Data

US 2012/0305736 A1 Dec. 6, 2012

Related U.S. Application Data

(62) Division of application No. 12/460,379, filed on Jul. 17, 2009, now Pat. No. 8,074,953.

(60) Provisional application No. 61/191,847, filed on Sep. 12, 2008.

(51) Int. Cl.
*A47B 97/04* (2006.01)

(52) U.S. Cl.
USPC ..... 248/462; 248/458; 248/460

(58) Field of Classification Search
USPC ..... 248/447, 462, 458, 460
See application file for complete search history.

(56) References Cited

U.S. PATENT DOCUMENTS 2,709,440 A * 5/1955 Donato et al. ..... 281/49
5,868,099 A * 2/1999 Begin ..... 116/234
6,089,609 A * 7/2000 Denley ..... 281/42
8,074,953 B1 * 12/2011 McKellar ..... 248/462

* cited by examiner

*Primary Examiner* — Amy J Sterling
(74) *Attorney, Agent, or Firm* — Roger A. Gilcrest

(57) ABSTRACT

The present invention includes a collapsible book holder adapted to hold a book in an open position. The present invention preferably is adapted to be folded into a flat or substantially flat position where it may be conveniently placed in a pocket or purse, or placed in a book as a book mark.

16 Claims, 17 Drawing Sheets

COLLAPSIBLE BOOK HOLDER

RELATED APPLICATION DATA

This application is a divisional of U.S. application Ser. No. 12/460,379, filed Jul. 17, 2009, now U.S. Pat. No. 8,074,953, which claims the priority benefit of U.S. Provisional Patent Application Ser. No. 61/191,847, filed Sep. 12, 2008, which, along with the references referred to therein, are hereby incorporated herein by reference.

BACKGROUND OF THE INVENTION

Books of bound leaves are common articles known from antiquity. They may be found either as paperback or hard back types and in various dimensions. Often books are taken to restaurants, lunchrooms, offices, picnic tables and elsewhere to be read while the reader is also eating a meal. A device is needed to hold a book open and its leaves restrained so that the reader may use his hands for eating while also reading. Similarly, students, office workers, musicians, cooks and others have need for a device for holding a book open for viewing and while also handwriting, using a keyboard, playing a musical instrument, cooking or engaging in leisure activities.

Despite an obvious and long-standing need, no portable article or device has gained wide use. In order to attain wider acceptance, a portable device should probably combine the following characteristics: compactness, light weight, inconspicuousness, low cost and adaptability to books of various sizes. At the same time such a device should function well when used to restrain the pages of a book and while also allowing the pages to be turned easily. A folding wire-frame device for holding a book upright and open (U.S. Pat. No. 3,007,278) is sold in bookstores but rarely seen in public areas. The device is too expensive for its use, not easily carried in a book, too conspicuous for use in public places and has a tendency to fold up when used with small paperback books. A book weight consisting of two weights sewn into the ends of a leather strip approximately eight inches in length is also widely sold. This article is heavy by design and too bulky to be carried within the pages of a closed book.

There are various methods of holding a book open, such as using two hands or the thumb and a finger of one hand to retain the pages back. Other known methods include applying pressure with one or two hands on a stable surface, such as a table or the lap of the reader. However, these methods can provide discomfort to the reader after a prolonged time.

Various products exist in the market to address this problem. For example, there are book holders that permit the reader to place the book on a stand on a desk or other flat, stable surface. These book holders, however, are limited in their use or ease of operation. Tabletop book holders limit the position and location in which a reader can read the book. For example, a reader cannot use a tabletop book holder when reading in bed, on the sofa, in a bath, in the gym, when traveling, etc. The book holders currently known are generally too cumbersome to carry during travel, making it impractical.

In addition, it is desirable to be able to have a book holder that maintains the book in an open position, particularly newer books or paperback books that tend to urge themselves closed.

It is also desirable to be able to have a book holder that may be collapsed substantially flat so that it may be carried separately, such as in a purse or pocket, or enclosed within the book itself.

The foregoing and other objects, features, and advantages of this invention will become more readily apparent from the following detailed description of a preferred embodiment which proceeds with reference to the accompanying drawings, wherein the preferred embodiment of the invention is shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive.

SUMMARY OF THE INVENTION

The present invention includes a collapsible book holder adapted to hold a book in an open position. The present invention preferably is adapted to be folded into a flat or substantially flat position where it may be conveniently placed in a pocket or purse, or placed in a book as a book mark.

The present invention includes a portable device for holding a book open for reading or viewing. The device is designed to be folded into a compact configuration similar in size and shape to a bookmark or a pair of bookmarks and inserted (at least partly) between the leaves of a closed book for carrying. For use as a book holder, elements of the device may be extended and reconfigured in combination with a book in order to hold the book open and restrain the pages for reading without the use of the hands.

In general terms, the present invention includes a collapsible book holder for holding a book in an open position, comprising: a pair of opposed first and second sides, (a) the first side comprising a first short leg and a first long leg, each having first and second ends and being moveably connected at the first ends by a first side connector adapted to permit movement of the first legs from a position substantially alongside one another to a position forming a first angle of less than 90 degrees; (b) the second side comprising a second short leg and a second long leg, each having first and second ends and being moveably connected at the first ends by a second side connector adapted to permit movement of the second legs from a position substantially alongside one another to a position forming a second angle of less than 90 degrees; (c) a short leg connector connecting the second end of the first short leg to the second end of the second short leg which connector is adapted to permit movement of the first and second short legs from a position substantially alongside one another to a position forming a third angle of greater than 90 degrees; and (d) a long leg connector connecting the second end of the first long leg to the second end of the second long leg which connector is adapted to permit movement of the first and second long legs from a position substantially alongside one another to a position forming a fourth angle of greater than 90 degrees; whereby the book holder is adapted to be reversibly moved from a configuration wherein the legs are substantially alongside one another to an open position shaped to hold a book while in an open position. The open position will typically provide a generally triangular form, in some embodiments with bowed sides, allowing an open book to be placed in the open space when in the open position, as more clearly described in the drawings. Normally, the first and second angles are less than 45 degrees, and the third angle is about 180 degrees. Most preferably, the triangular form is such that the first and second angle are less than 45 degrees, the fourth angle is greater than 90 degrees, and the third angle is about 180 degrees.

The legs make be attached by any means or fixtures consistent with their reversible movement between the open and closed positions as described herein. It is also preferred that the first and second side connectors are hinges. It is also preferred that the long leg connector comprises a double joint hinge.

It is further preferred that at least one of the long leg connector and short leg connector is adapted to hold its position when in the open position.

The collapsible book holder may have legs that comprise a material selected from the group consisting of wood, bamboo, metal, composite and plastic materials, consistent with their reversible movement between the open and closed positions as described herein.

In a preferred embodiment, each of the long legs each additionally comprises a compressible material attached thereto and extending respectively toward the short legs, or most preferably each of the long legs each additionally comprises a member attached so as to be reversibly extended respectively toward the short legs. As an example, each of the long legs each additionally comprises a flexible member having two ends, one end fixed to the respective leg and the other end slide-ably attached to the respective leg, so as to be reversibly bowed toward and away from the short legs.

In an optional embodiment, each of the long legs is each additionally comprised of a flexible, springy or spring-loaded member having two ends, one end attached to the respective leg, so as to reversibly spring toward and away from the short legs.

A collapsible book holder of the present invention may have its first and second side connectors or hinges provided with springs to draw the first short leg to a position substantially alongside the first long leg and the second short leg to a position substantially alongside the second long leg.

As an optional feature, each of the short legs may have an extension adapted to maintain a book placed within the book holder at an angle to the surface upon which it is placed.

The collapsible book holder of the invention may optionally include in the long leg connector or the double joint hinge, a light fixture.

In another embodiment, the collapsible book holder of the present invention includes a pair of first and second sides, (a) the first side comprising a first short leg and a first long leg, each having first and second ends and being connected at the first ends by a first side connector adapted to hold the first ends a fixed distance apart; (b) the second side comprising a second short leg being shorter than the first short leg and a second long leg being shorter than the first long leg, each having first and second ends and being connected at the first ends by a second side connector being longer than the first side connecter, adapted to hold the first ends a fixed distance apart; (c) a pivoting joint connecting the second end of the first short leg to the second end of the second short leg adapted to permit movement of the first short leg from a position substantially alongside the second short leg to another position, forming a first angle of less than 180 degrees, the first and second short legs being substantially un-bowed; (d) a pivoting joint connecting the second end of the first long leg to the second end of the second long leg adapted to permit movement of the first long leg from a position substantially alongside the second long leg to another position, forming a second angle of less than 180 degrees being substantially equal to the first angle; whereby the book holder is adapted to be reversibly moved from a configuration where the legs are substantially alongside one another to an open position shaped to hold a book while in an open position.

The first and second long legs may be substantially bowed or angled, and the first and second short legs may be substantially straight or unbowed.

The first and second ends of the second portion may additionally comprise support legs extending therefrom, to angle the book from the supporting surface.

It is preferred that the second side is sized and shaped so as to be capable of being substantially nested within the first side.

The collapsible book holder may have legs that comprise a material selected from the group consisting of wood, bamboo, metal, composite and plastic materials, consistent with their reversible movement between the open and closed positions as described herein, although plastic is preferred for its formability.

The collapsible book holder of the present invention may be provided with a display of words or designs of an advertising, promotional, inspirational, educational, artistic or decorative nature.

The present invention also includes a collapsible book holder in accordance with any of the embodiments thereof as described herein, in an open position and a book placed therein, in combination.

Another optional feature of the book holder of the present invention (which may be used with any of the variations of present invention) would be to provide short support legs (about 0.5 to about 1.5 inches long) extendable from the bottom horizontal legs of the device (legs 6 and 7 in the Figures). The purpose of the support legs is to raise the top part of the opened book thus inclining the book at about 25 degrees from a horizontal surface toward the reader, so as to provide an incline angle as is often seen in book rests, so as to make the book easier to read.

This may be done through any number of mechanical arrangements whereby the short angling legs are incorporated into the book holder, such as by having the short support legs attached to or embedded into (preferably flush), and within the dimensions of legs 6 and 7, such that they may be folded out when the device is set up. In a less preferred design, support legs could slide out of tubes or hollow sections of legs 2 and 3 to angle the book toward the reader when in the book holder. Other equivalent arrangements will be apparent to those skilled in the art.

DETAILED DESCRIPTION OF THE PREFERRED EMBODIMENTS

In accordance with the foregoing summary, the following provides a detailed description of the preferred embodiment, which is presently considered to be the best mode thereof.

Figure 1:
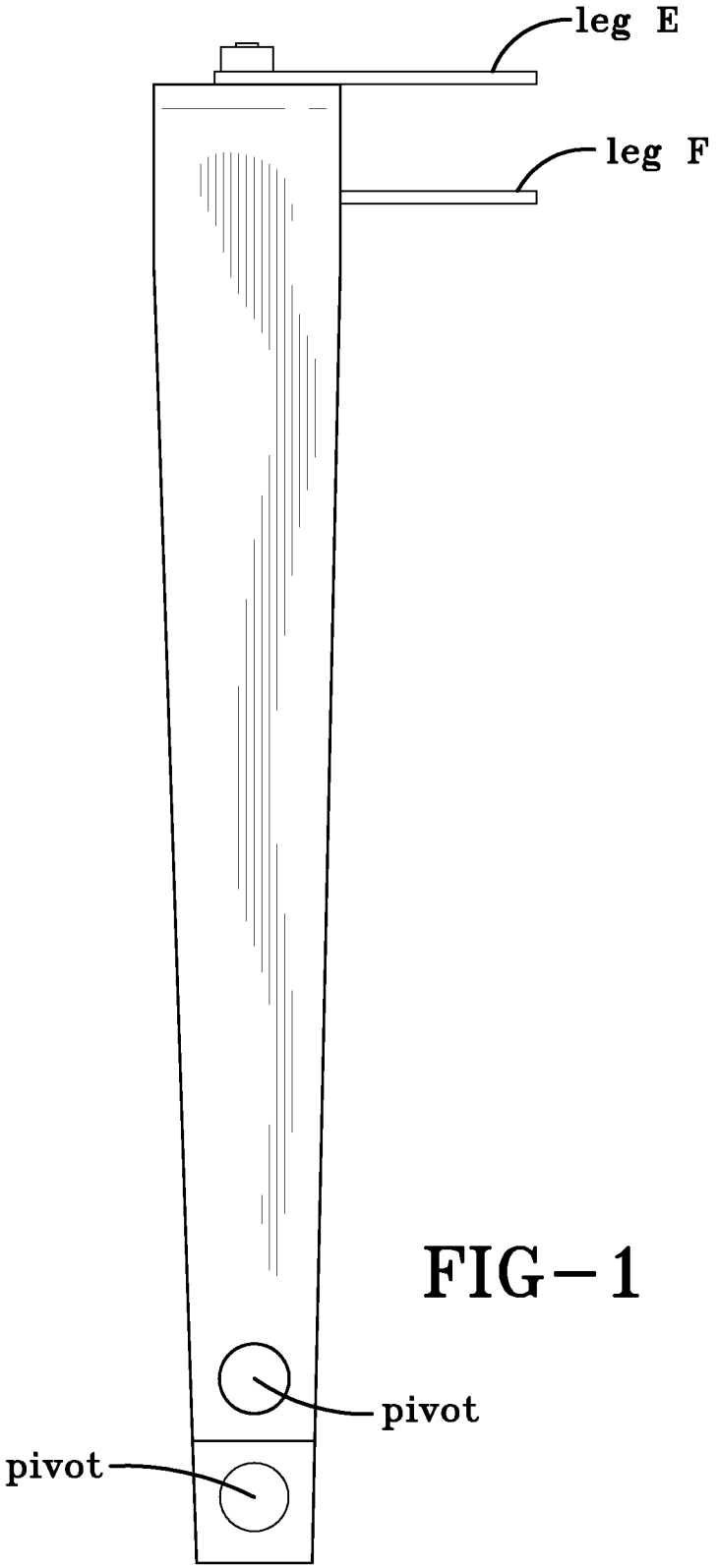
FIG. 1 is an elevation view of a collapsible book holder in accordance with one embodiment of the present invention.
Figure 2A:
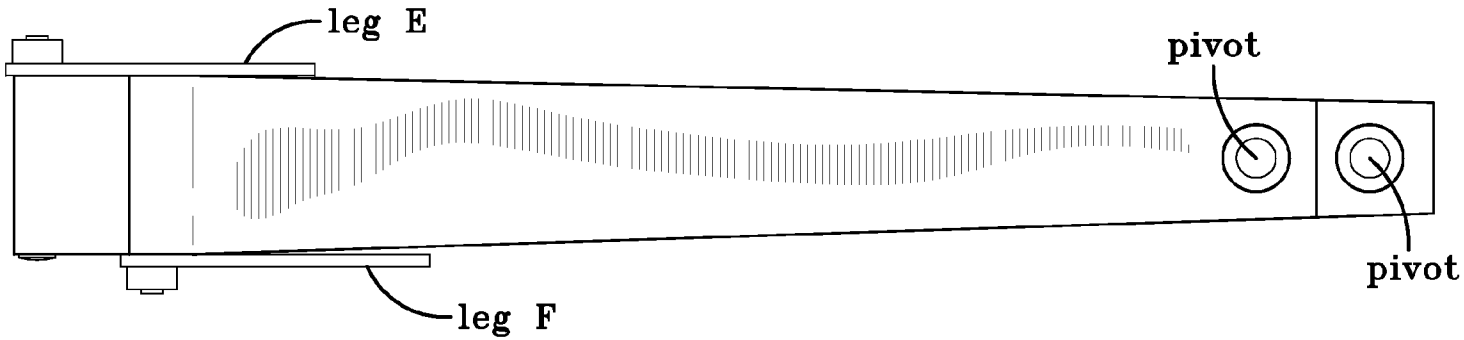
FIGS. 2A and 2B are top and side elevation views respectively of a collapsible book holder in accordance with one embodiment of the present invention.
Figure 2B:
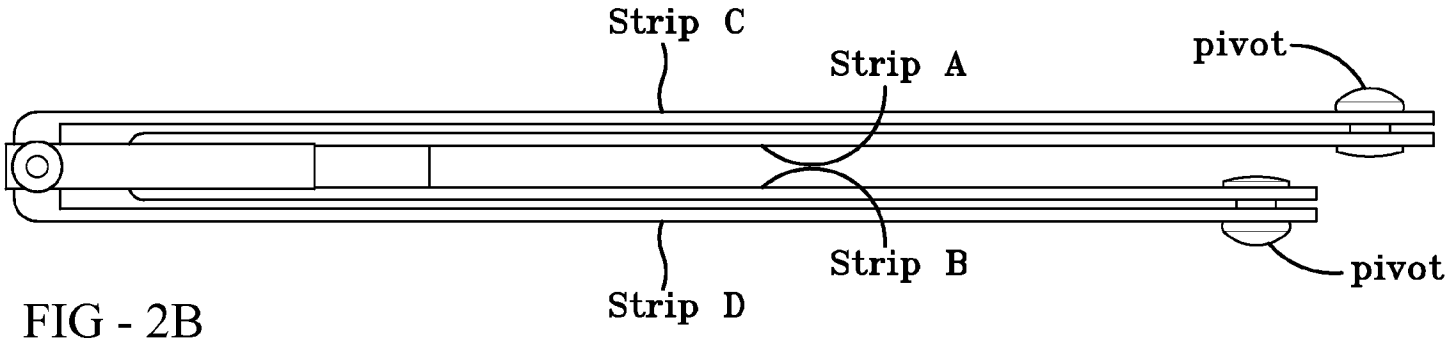
Figure 3:
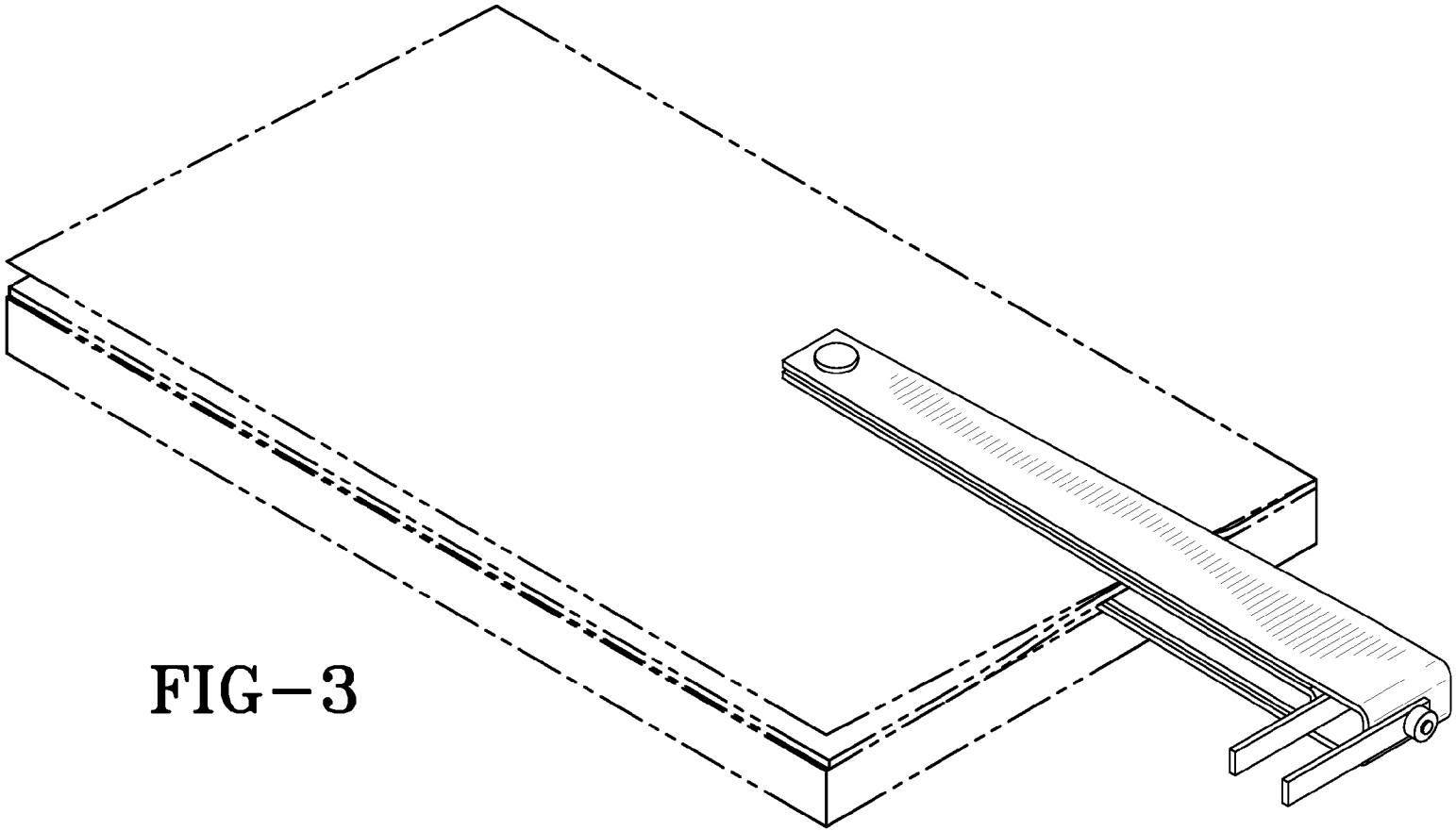
FIG. 3 is a perspective view of a book and a collapsible book holder inserted therein, in accordance with one embodiment of the present invention.

FIGS. 1, 2A and 2B show a portable book holder folded into its most compact configuration. As shown in FIG. 3, it is designed to be slid between the pages of a book or partly inserted between the pages while the remainder extends along the outside of the book.

The present invention as shown in FIGS. 1, 2A and 2B is comprised of four strips of thin flexible material such as metal, wood, laminate or composite but preferably a very clear plastic such as acrylic, polystyrene, polyethylene or polyester terephthalate. Strips A and B (B being slightly longer than A) are joined or fused together at one end of each in order to hold the planes of the strips parallel and a few millimeters apart forming pair A-B. Strips C and D (D being slightly longer than C) are joined or fused together along one end of each in order to hold the planes of the strips parallel and separated by sufficient space to allow strips A and B to be nested in between the outer strips (forming pair C-D). Strips A and C are joined by a pivot or hinge near the open ends of the pairs A-B and C-D. Likewise strips B and D are joined by a pivot or hinge near the open ends of the pairs A-B and C-D. Short folding legs E and F are joined by hinges or pivots to the fused end of pairs A-B and C-D, respectively as shown.

FIG. 3 shows a portable book holder folded into its most compact configuration and clipped onto a closed book, so as to be partly inserted between the pages while the remainder extends along the outside of the book.

Figure 4:
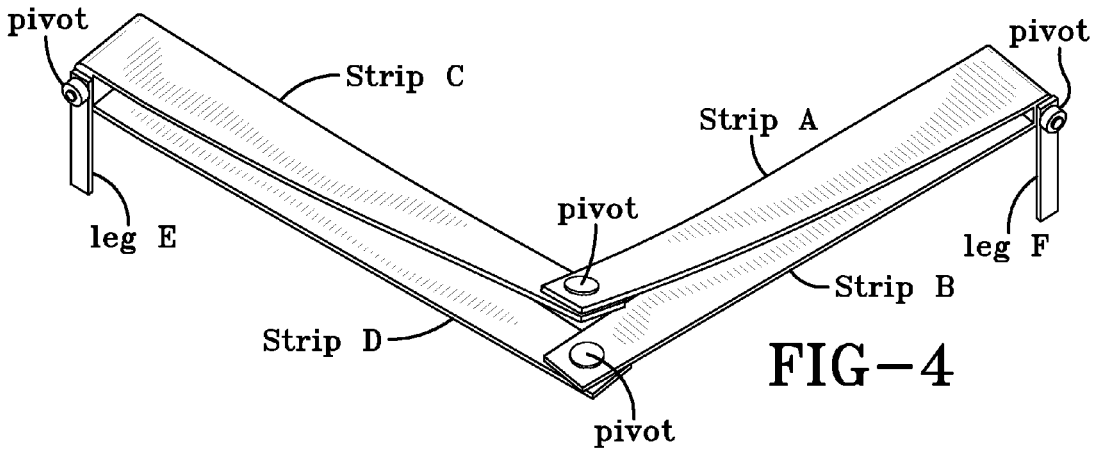
FIG. 4 is a perspective view of a collapsible book holder accordance with one embodiment of the present invention.
Figure 5:
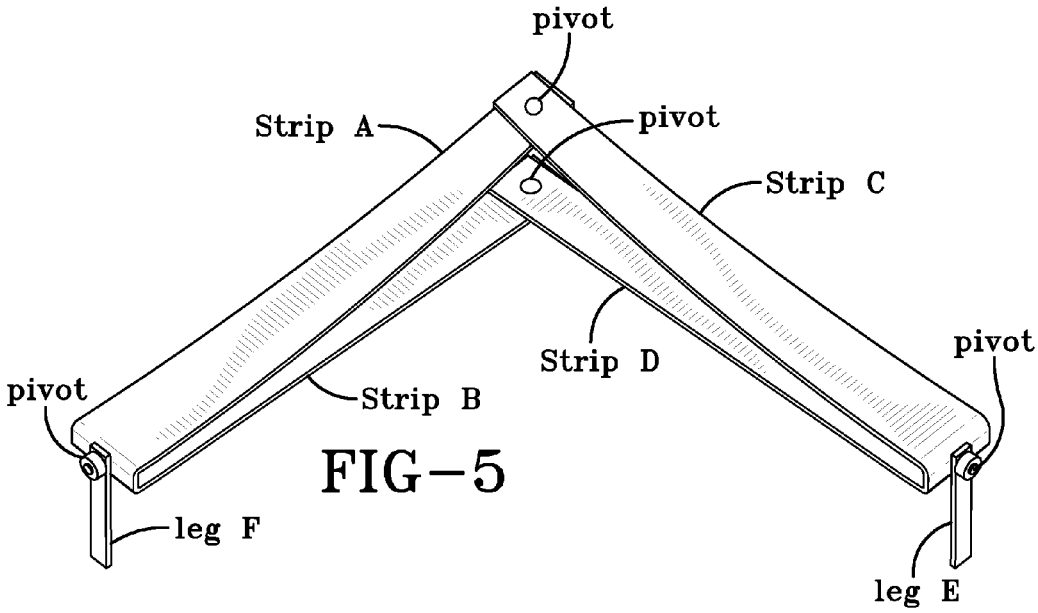
FIG. 5 is a perspective view of a collapsible book holder accordance with one embodiment of the present invention.

When the device is used as a book holder, the pair A-B is pivoted away (left or right) from pair C-D and the open ends are thus caused to spread apart by their unequal lengths forming the bowed shape as shown in FIGS. 4 and 5. Pairs A-B and C-D may be rotated at an angle of 0 to 180° from each other, to the left or right. A preferred use is to separate pair A-B from pair C-D by angle of between about 90 and 150° forming a "V" shape. The book is opened and placed between the bowed open strips, the front cover and some earlier pages of the book held by pair A-B and the back cover and later pages held by pair C-D. Two legs E and F may be folded into a configuration forming a three-point base with the vertex of strips B and D forming the third point.

Figure 6:
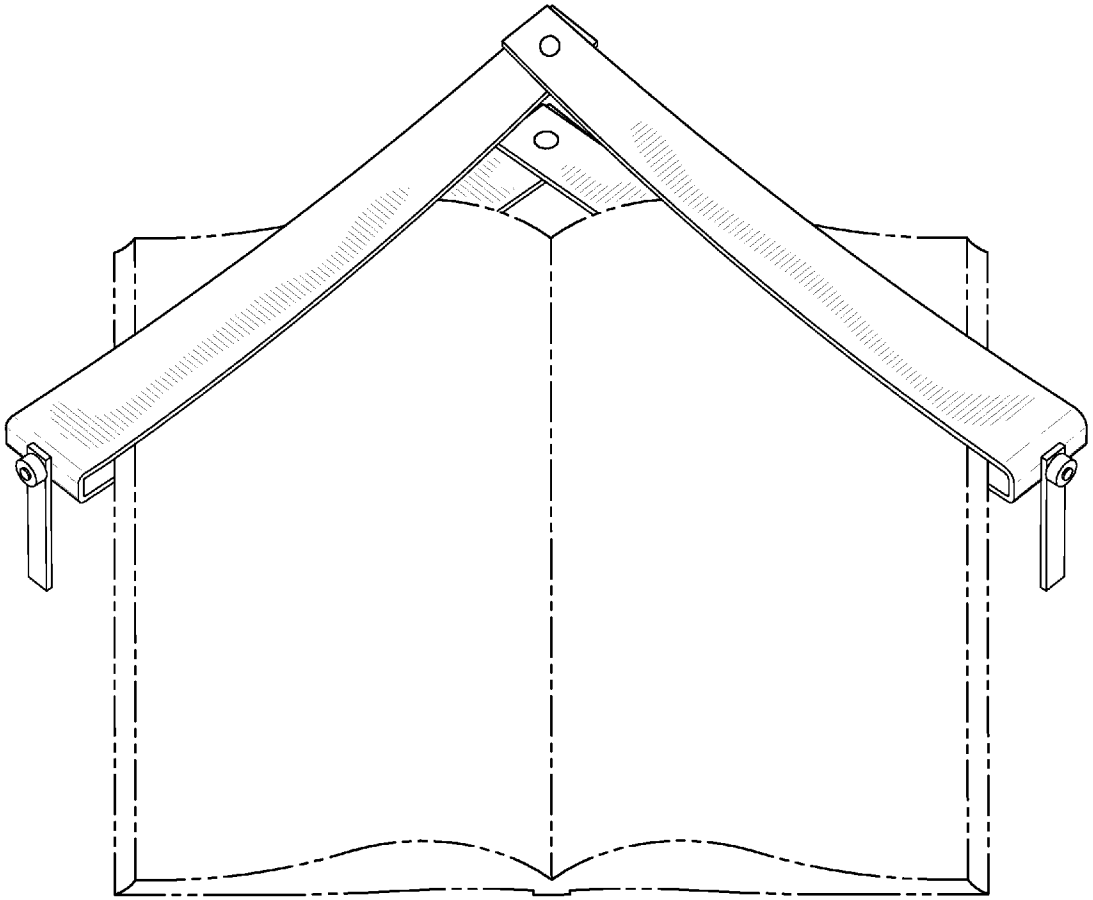
FIG. 6 is an elevation view of a book in an open position and being held in that position by a collapsible book holder, in accordance with one embodiment of the present invention.

FIG. 6 is an elevation view of a book in an open position and being held in that position by a collapsible book holder, in accordance with one embodiment of the present invention.

Figure 7:
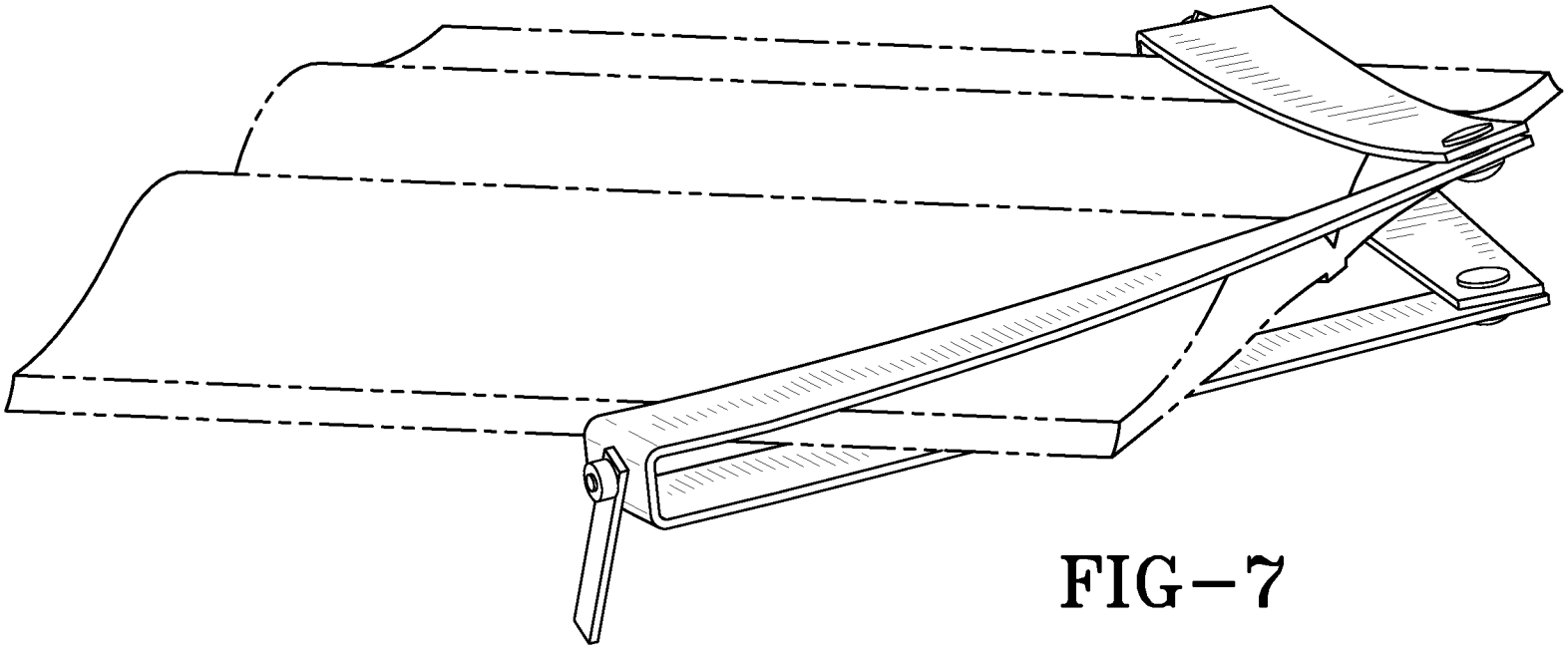
FIG. 7 is a perspective view of a book in an open position and being held in that position by a collapsible book holder, in accordance with one embodiment of the present invention.

FIG. 7 is a perspective view of a book in an open position and being held in that position by a collapsible book holder, in accordance with one embodiment of the present invention.

Figure 8A:
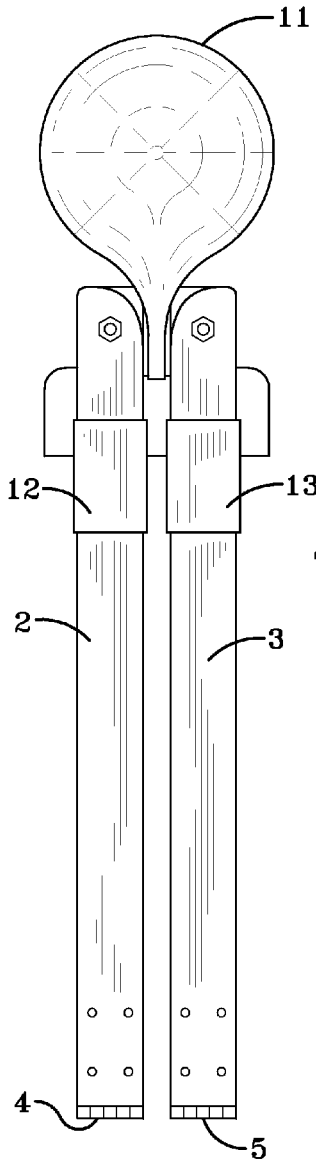
FIGS. 8A and 8B are top and bottom elevation views respectively of a collapsible book holder in accordance with one embodiment of the present invention.
Figure 8B:
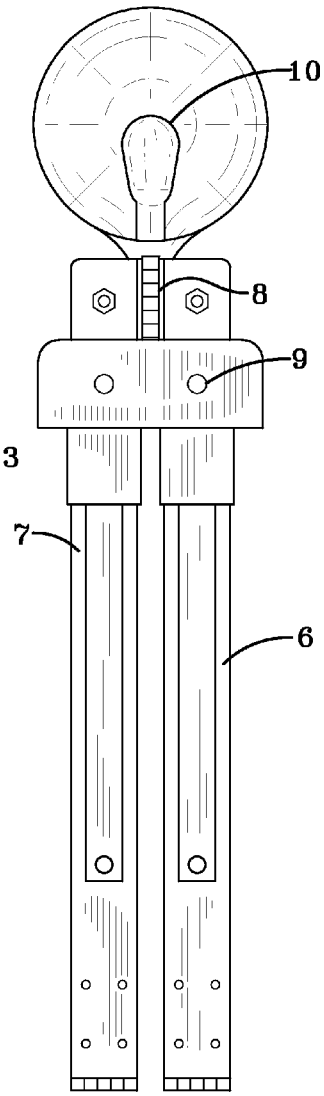

FIGS. 8A and 8B show one embodiment of the book holder 1 of the present invention in the collapsed position.

This Figure shows the pair of relatively longer legs 2 and 3 attached by hinges 4 and 5 to respective relatively shorter legs 6 and 7. Connecting relatively longer legs 2 and 3 to one another is swivel hinge 8. Connecting relatively shorter legs 6 and 7 to one another is swivel joint 9. Attached to or integrated into swivel hinge 8 is optional reading light 10 with shade portion 11. Also shown in this Figure are optional sliders 12 and 13 that control the distension of the holding bands (not shown, but seen in FIGS. 9 and 10).

Figure 9:
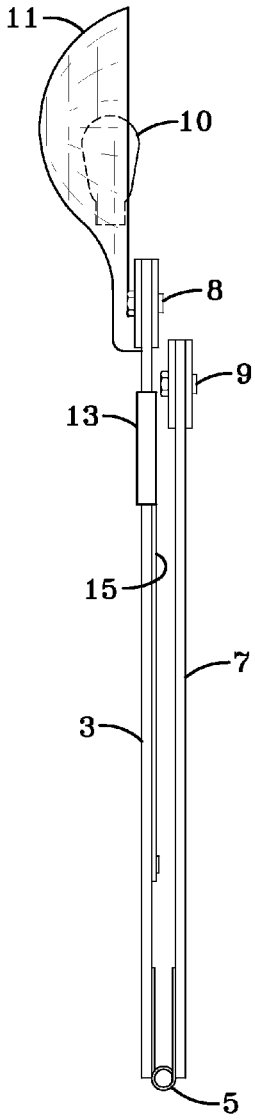
FIG. 9 is a side elevation view of a collapsible book holder in accordance with one embodiment of the present invention.

FIG. 9 shows one embodiment of the book holder 1 of the present invention in side elevation view and showing the attachment of an optional reading light.

Figure 10:
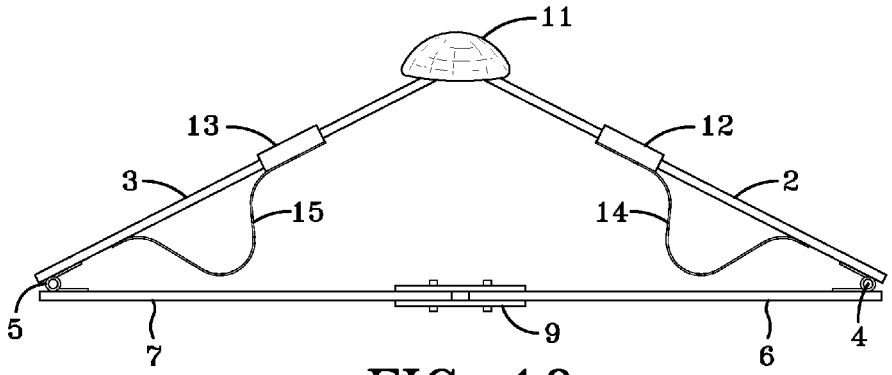
FIG. 10 is a side elevation view of a collapsible book holder being configured for insertion of a book in accordance with one embodiment of the present invention.

FIG. 10 shows one embodiment of the book holder 1 of the present invention in the extended, unfolded position and showing the attachment of an optional reading light.

This Figure shows the pair of relatively longer legs 2 and 3 attached by hinges 4 and 5 to respective relatively shorter legs 6 and 7. Connecting relatively longer legs 2 and 3 to one another is swivel hinge 8 (not shown). Connecting relatively shorter legs 6 and 7 to one another is swivel joint 9. Attached to or integrated into swivel joint 8 is optional reading light 10 with shade portion 11. Also shown in this Figure is optional sliders 12 and 13 that control the distension of the holding bands 14 and 15, which are fixed respectively to relatively longer legs 2 and 3.

After the book holder 1 is placed in the extended open position by opening hinges 4 and 5, and opening swivel hinge 8 and swivel joint 9, in order to form an isosceles triangular form, the optional sliders 12 and 13 may be slid to a different position along their respective longer legs in order to cause holding bands 14 and 15 to extend into the triangle defined by the holder in order to hold down an open book extended into the perimeter of the book holder 1.

Figure 11:
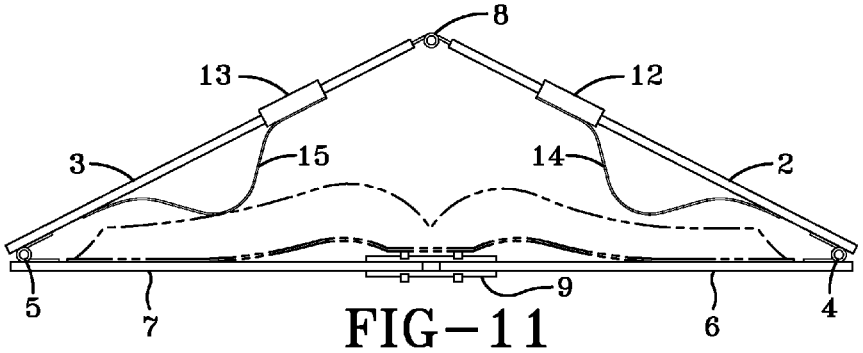
FIG. 11 is a side elevation view of a collapsible book holder being configured for restraining the pages of a book with the insertion of a book in accordance with one embodiment of the present invention.

FIG. 11 is an elevation view of a book in an open position and being held in that position by a collapsible book holder 1, in accordance with one embodiment of the present invention.

Figure 12:
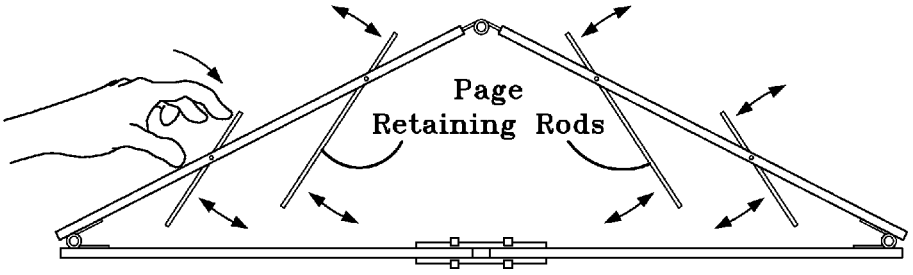
FIG. 12 is a side elevation view of a collapsible book holder being configured for restraining the pages of an inserted book in accordance with one embodiment of the present invention.

FIG. 12 shows one embodiment of the book holder 1 of the present invention in the extended, unfolded position and showing the attachment of optional spring-loaded rod page retainers.

Figure 13B:
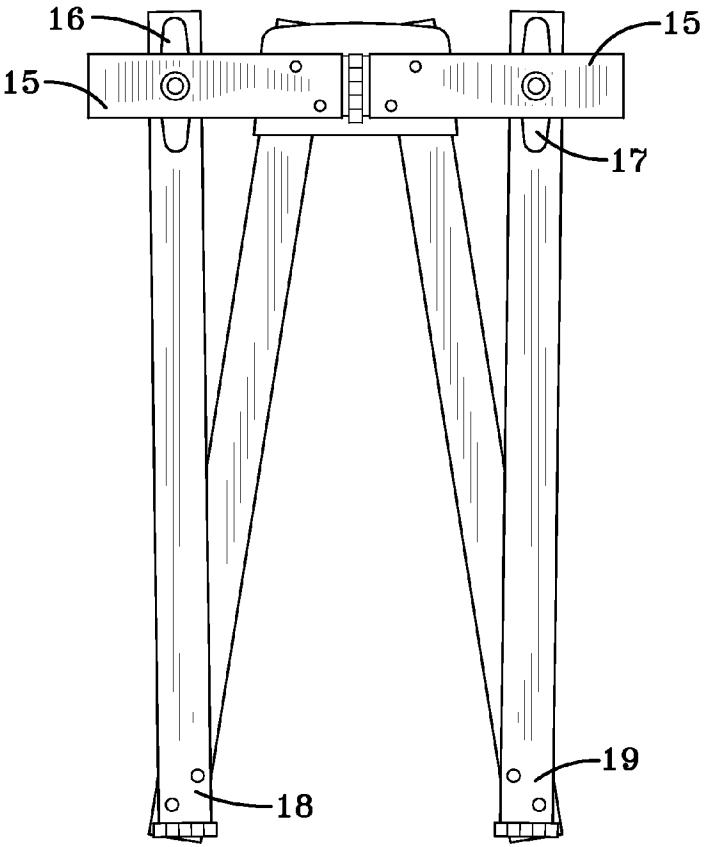
FIGS. 13A and 13B are first and second side elevation views respectively of a collapsible book holder in accordance with one embodiment of the present invention.
Figure 13A:
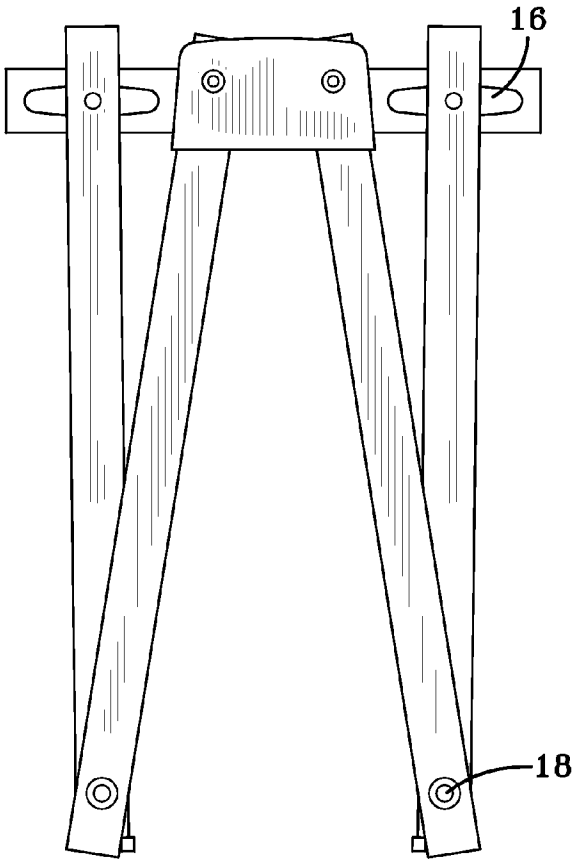

Another variation of the present invention is shown in FIGS. 13A and 13B. This embodiment may be constructed with an extended swivel hinge 15 and spring-loaded joint locks 16 and 17 and pivoting hinges 18 and 19 such that when force is applied with the fingers or thumbs to the center or to the ends of the of the extended swivel hinge 15 leverage is obtained, allowing the book holder to rapidly and easily extend to the unfolded position and to be held in such position by the spring loaded joint locks 16 and 17.

Figure 14A:
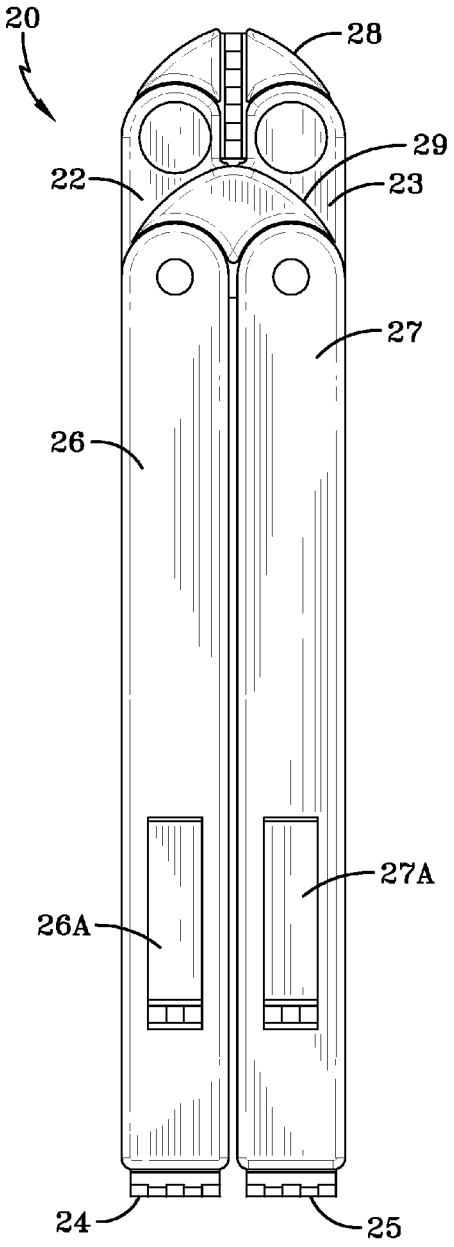
FIGS. 14A, 14B and 15 are top and bottom elevation views respectively of a collapsible book holder in accordance with another embodiment of the present invention.
Figure 14B:
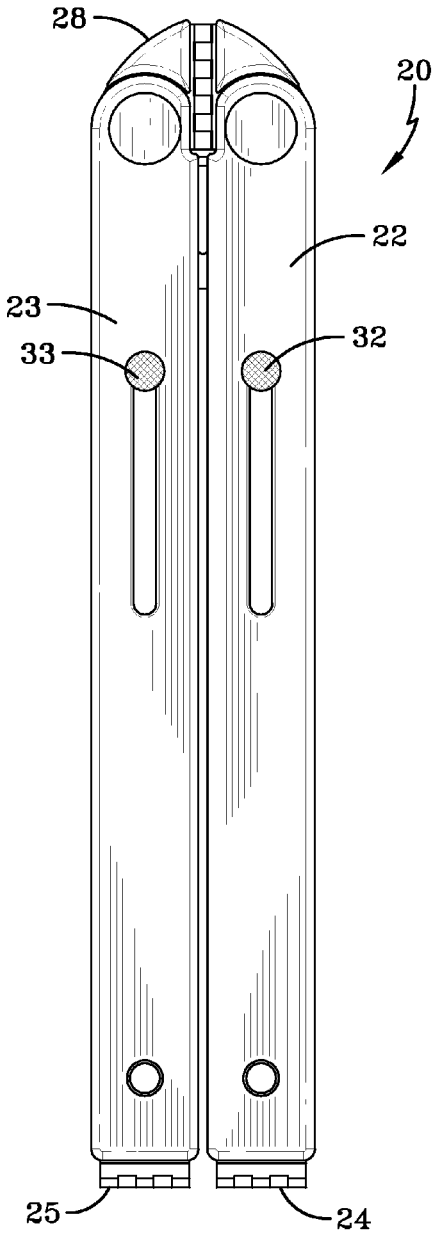

FIGS. 14A and 14B show another embodiment of a book holder 20 of the present invention in the collapsed position.

This Figure shows the pair of relatively longer legs 22 and 23 attached by hinges 24 and 25 to respective relatively shorter legs 26 and 27. Connecting relatively longer legs 22 and 23 to one another is swivel hinge 28. Connecting relatively shorter legs 26 and 27 to one another is swivel joint 29. The book holder of the present invention may also have optional collapsible extension legs that are adapted to be extended from a flush position in shorter legs 26 and 27 (on what becomes the bottom of the book holder when it is in the open position), such as collapsible extension legs 26A and 27A, which are shown in their flush position. These legs are reversibly moveable to an extended position such that, when the book holder is in the open position, they may extend so as to tilt the book toward the reader, similar in fashion to the legs E and F in FIGS. 1-3. Legs 26A and 27A may be hinged for this purpose. Legs 26A and 27A extend from the bottom of the book holder when it is in the open position. Alternatively, it will be appreciated that similar small legs may be hinged from the top surface of the shorter legs 26 and 27, such that the book may be slightly angled with respect to the shorter legs 26 and 27 to achieve a similar angled position of the book. The former arrangement however is preferred, as it does not impinge upon the space between the shorter legs 26 and 27 and the longer legs 22 and 23 when the book holder is in the open position.

Figure 15:
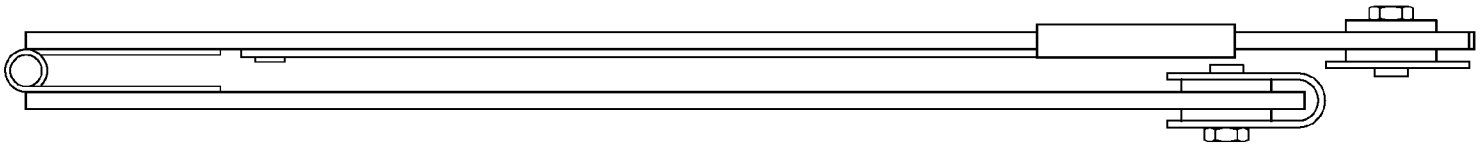

FIG. 15 shows the book holder 20 of the present invention in side elevation view with like reference numerals. Also shown in FIG. 15 are optional sliders 32 and 33 that control the distension of the holding bands 34 and 35 (not shown, but seen in FIGS. 16 and 20).

Figure 16:
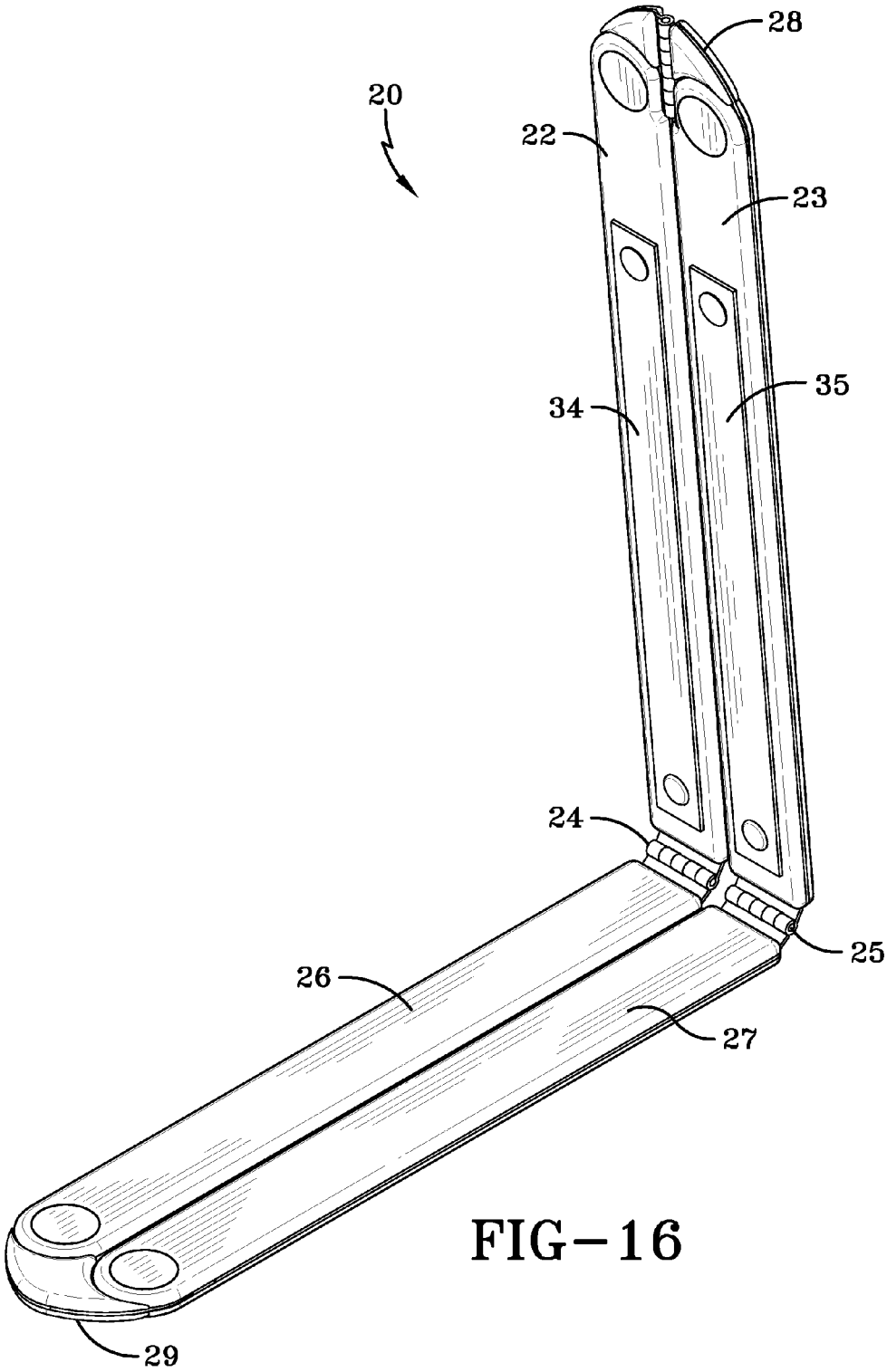
FIG. 16 is a perspective view of a collapsible book holder in accordance with another embodiment of the present invention.

FIG. 16 shows the book holder 20 of the present invention in side elevation view with like reference numerals. This Figure shows book holder 20 in a partially open configuration as the pair of shorter legs 26 and 27 and the pair of longer legs 22 and 23 are separated from one another by action of hinges 24 and 25. Holding bands 34 and 35 may be seen in their stored position in this view.

Figure 17A:
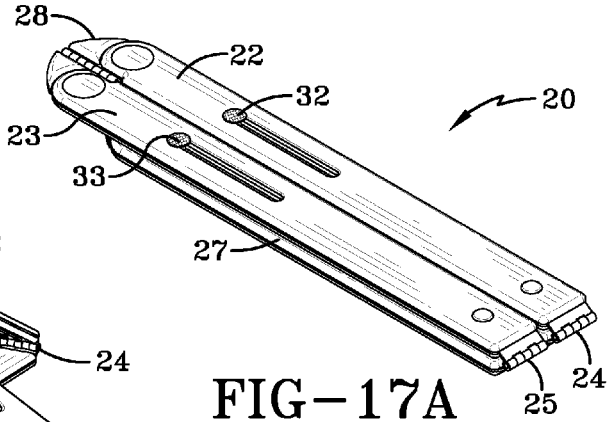
FIGS. 17A, 17B and 17C are perspective views of a collapsible book holder in accordance with another embodiment of the present invention, showing the progression from fully stored to fully deployed positions.
Figure 17B:
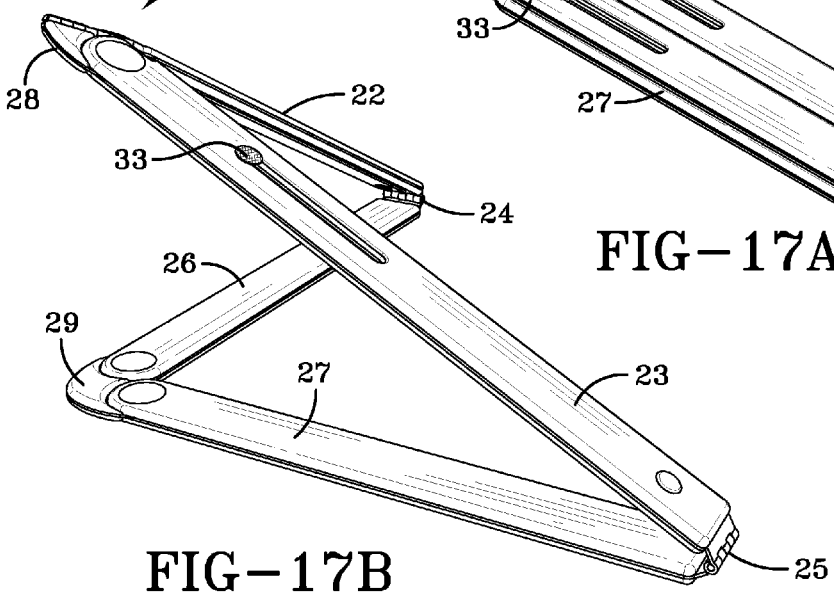
Figure 17C:
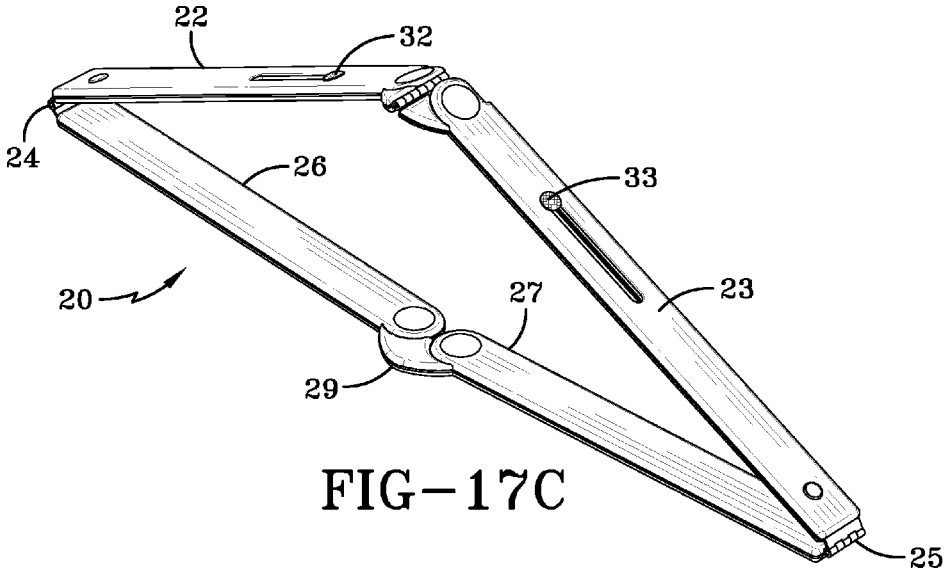

FIG. 17A shows a perspective view of the book holder 20 of the present invention with like reference numerals. FIGS. 17B and 17C shows perspective views of the book holder 20 of the present invention with like reference numerals, as it is opened progressively to its fully deployed position.

Figure 18:
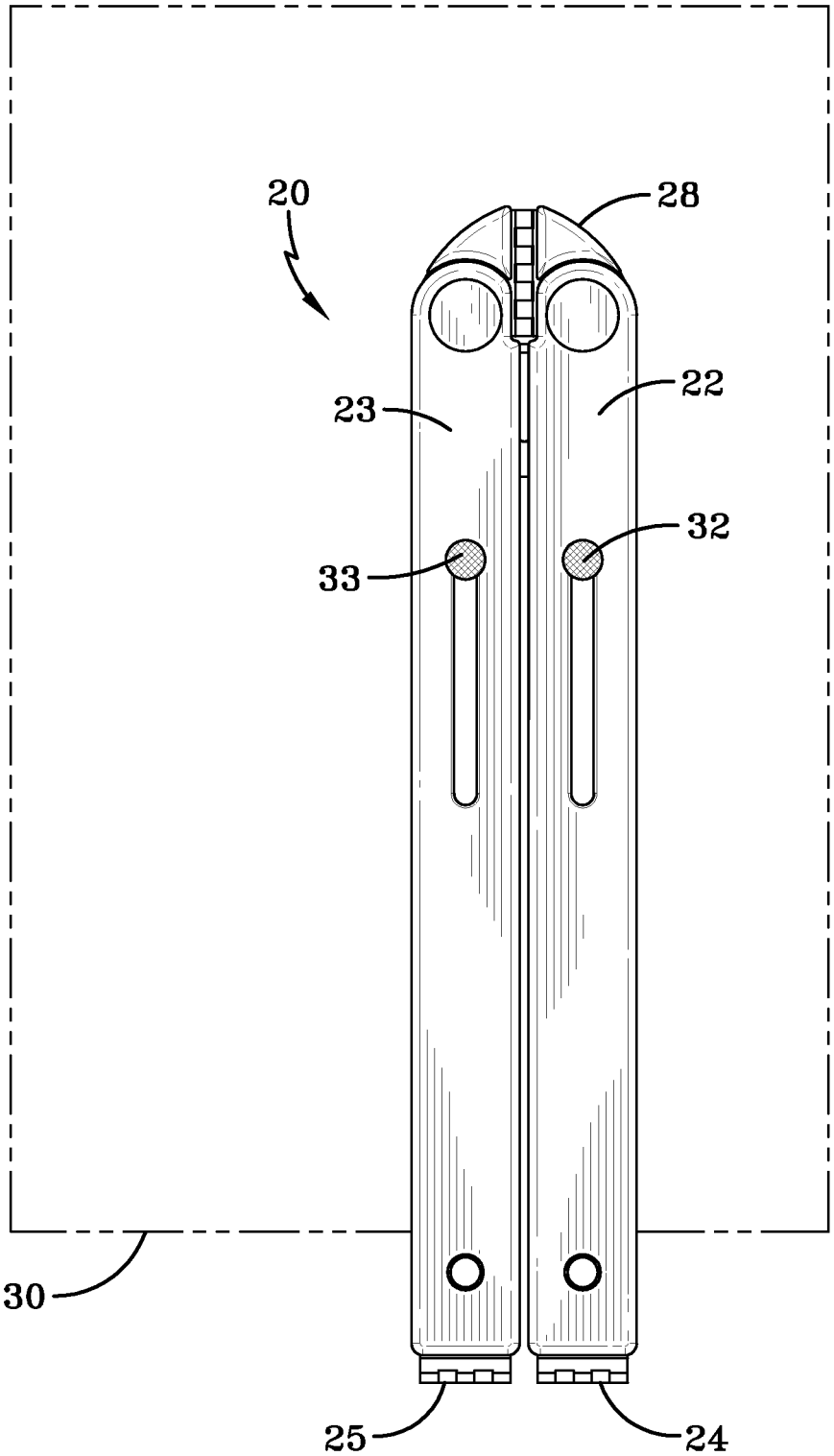
FIG. 18 is a bottom elevation view of a collapsible book holder in accordance with another embodiment of the present invention, shown held in the leaves of a book.

FIG. 18 shows the book holder 20 of the present invention in side elevation view with like reference numerals. This Figure shows book holder 20 in place with a portion of the book holder 20 placed within the leaves of a book 30.

Figure 19:
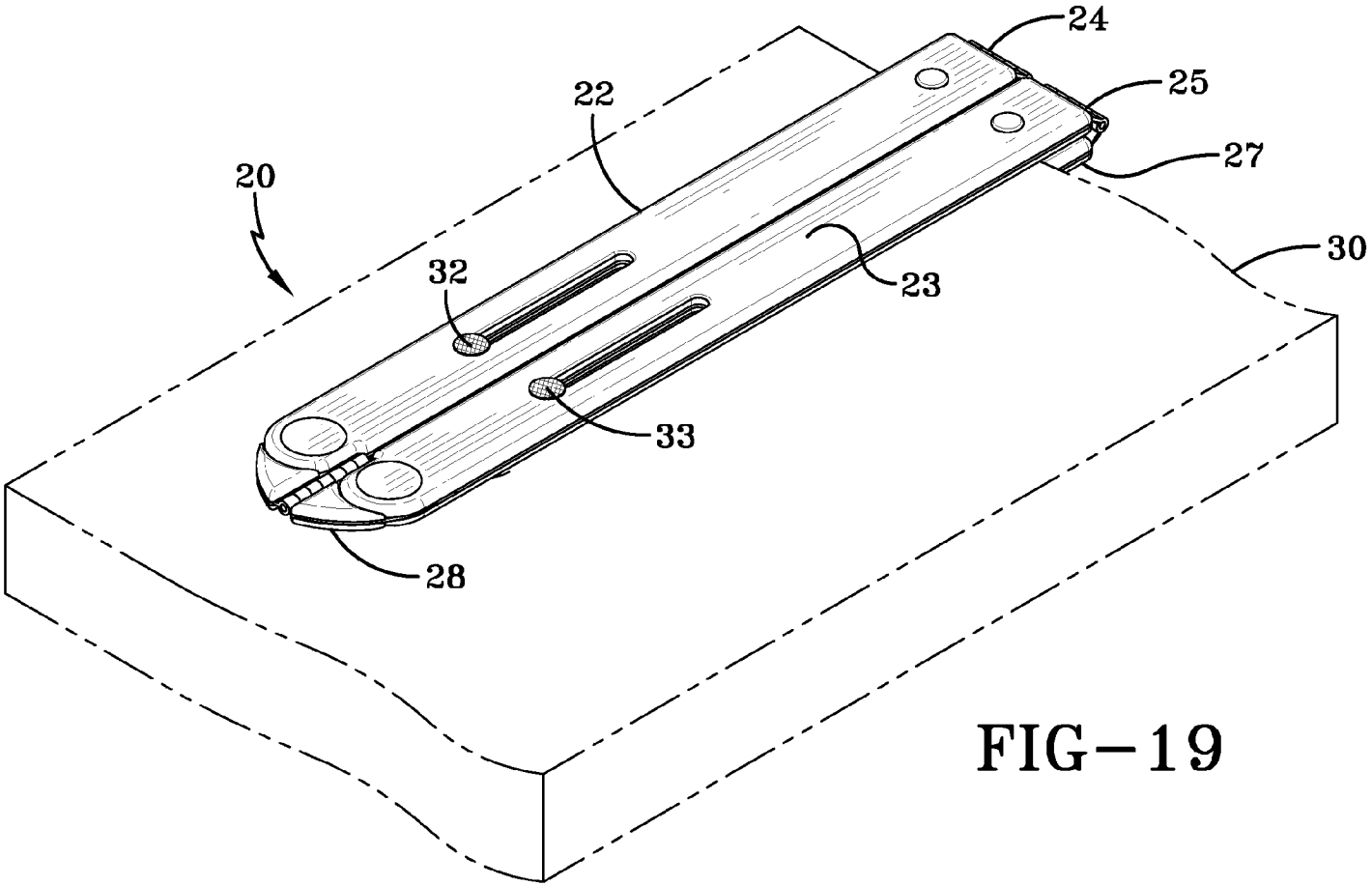
FIG. 19 is a perspective view of a collapsible book holder in accordance with another embodiment of the present invention, shown held in the leaves of a book.

FIG. 19 shows the book holder 20 of the present invention in perspective view with like reference numerals. This Figure shows book holder 20 in place with a portion of the book holder 20 placed within the leaves of a book 30.

Figure 20:
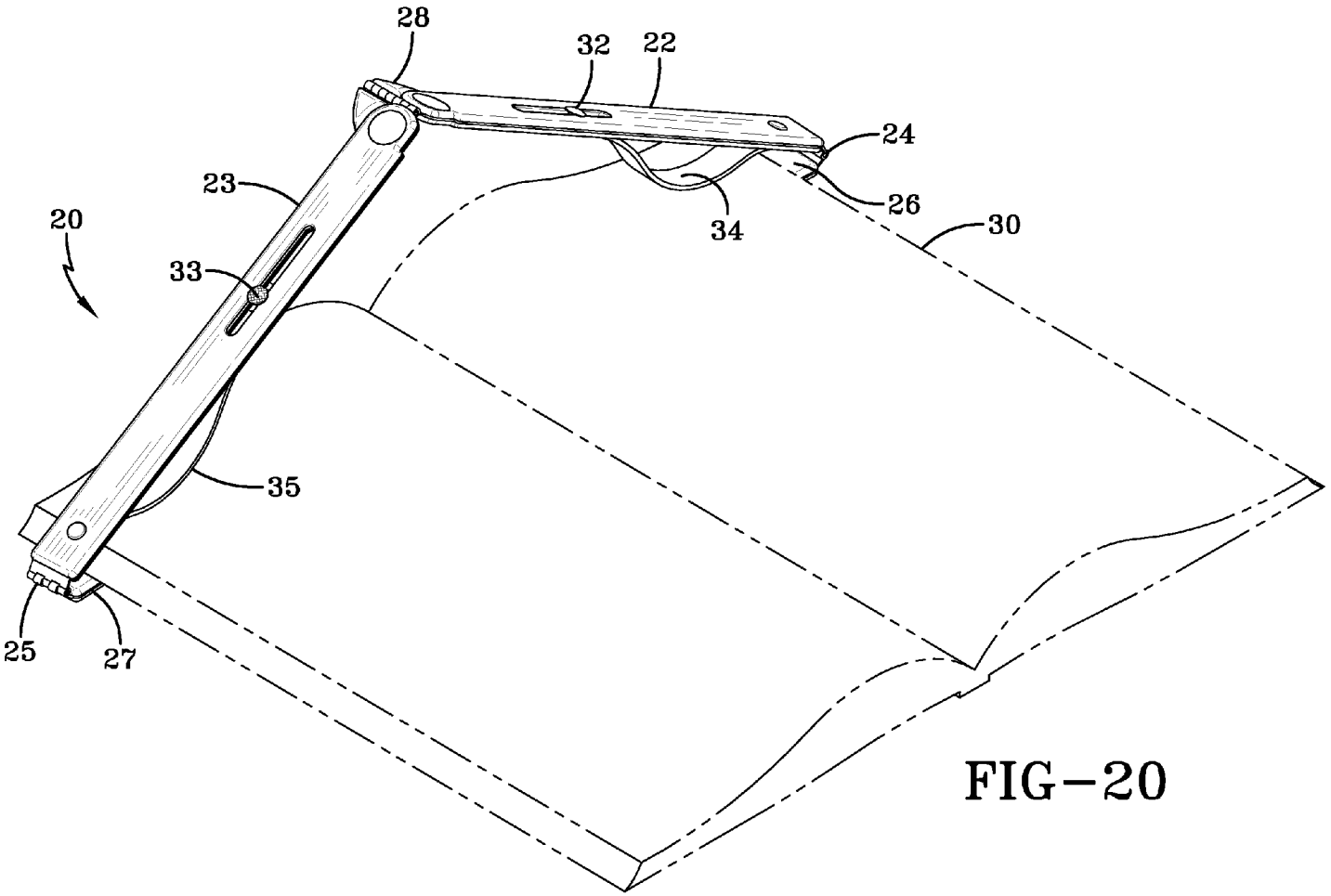
FIG. 20 is a perspective view of a collapsible book holder in accordance with another embodiment of the present invention, shown in the fully deployed position and holding the leaves of an open book.

FIG. 20 shows the book holder 20 of the present invention in perspective view with like reference numerals. This Figure shows book holder 20 in fully deployed position as shown in FIG. 17C, and in place with the book holder 20 placed over the open leaves of a book 30, and a portion of the book 30 extending through the triangular frame created thereby. This Figure also shows holding bands 34 and 35 which may be seen in their deployed position in this view. The holding bands 34 and 35 serve to hold the pages of book 30 in position.

Figure 21A:
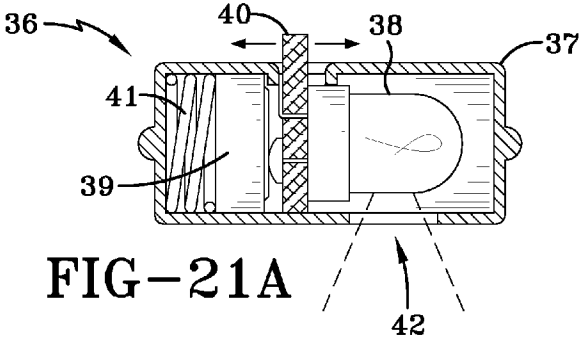
FIG. 21A is a partial cross-section view of a light fixture of the collapsible book holder in accordance with still another embodiment of the present invention, shown in FIG. 21.
Figure 21:
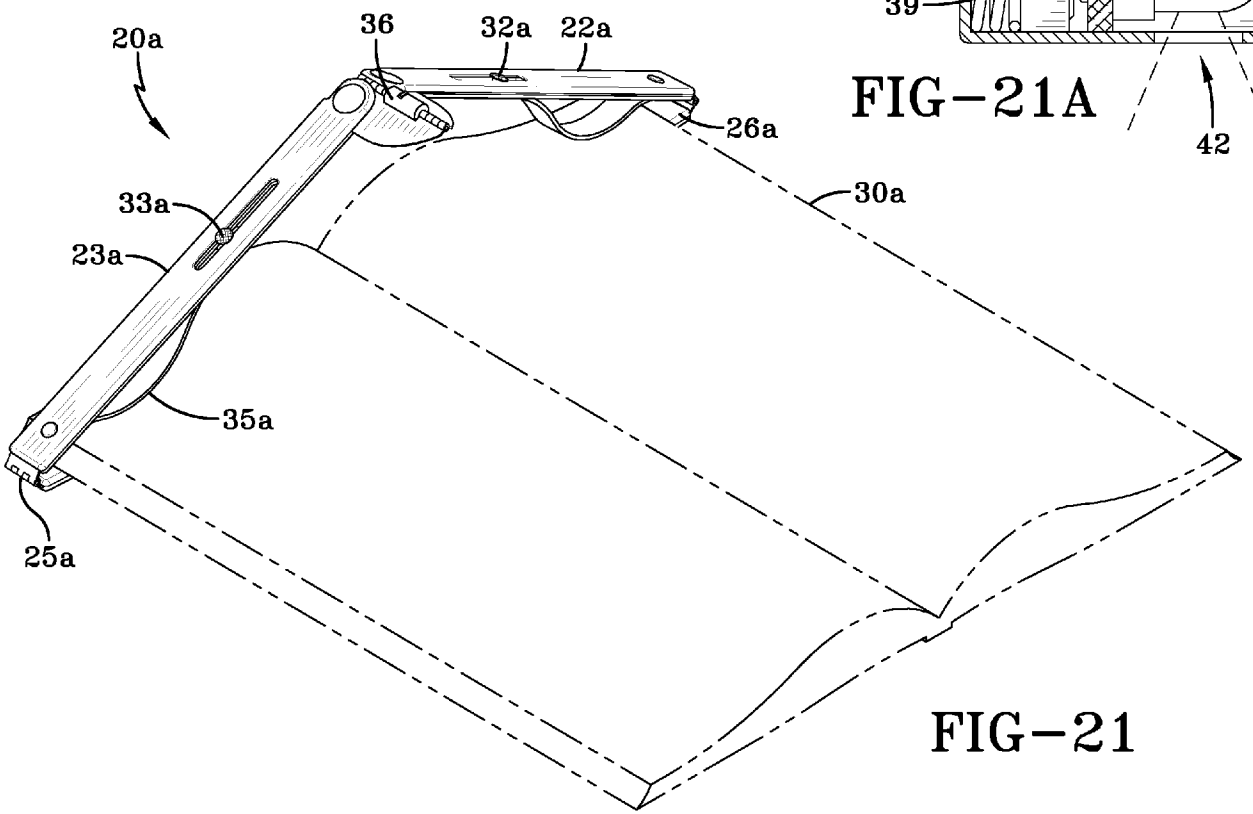
FIG. 21 is a perspective view of a collapsible book holder in accordance with still another embodiment of the present invention including a light fixture, shown in the fully deployed position and holding the leaves of an open book.

FIG. 21 is a perspective view of a collapsible book holder in accordance with still another embodiment of the present invention including a light fixture 36, shown in the fully deployed position and holding the leaves of an open book. This Figure shows book holder 20*a* in fully deployed position, similar to that shown in FIG. 17C, with the book holder 20*a* placed over the open leaves of a book 30*a*, and a portion of the book 30*a* extending through the triangular frame created thereby. This Figure also shows holding bands 34*a* and 35*a* which may be seen in their deployed position in this view. The holding bands 34*a* and 35*a* serve to hold the pages of book 30*a* in position.

FIG. 21A is a partial cross-section view of a light fixture of the collapsible book holder in accordance with still another embodiment of the present invention, shown in FIG. 21. FIG. 21A shows light fixture 36 with a housing 37 holding light bulb 38 that is powered by small battery 39 and is turned on and off by switch 40 cooperating with spring 41. The light is emitted though opening 42.

What is claimed is:

1. A collapsible book holder for holding a book in an open position comprising a pair of first and second sides comprising:

(a) the first side comprising a first short leg and a first long leg, each having first and second ends and being moveably connected at said first ends by a first side connector adapted to permit movement of said first legs from a position substantially alongside one another to a position forming a first angle of less than 90 degrees;

(b) and the second side comprising a second short leg and a second long leg, each having first and second ends and being moveably connected at said first ends by a second side connector adapted to permit movement of said second legs from a position substantially alongside one another to a position forming a second angle of less than 90 degrees;

(c) a short leg connector connecting the second end of the first short leg to the second end of the second short leg adapted to permit movement of the said first and second short legs from a position substantially alongside one another to a position forming a third angle of greater than 90 degrees; and (d) a long leg connector connecting the second end of the first long leg to the second end of the second long leg adapted to permit movement of the said first and second long legs from a position substantially alongside one another to a position forming a fourth angle of greater than 90 degrees;

whereby said book holder is adapted to be reversibly moved from a configuration where said legs are substantially alongside one another to an open position shaped to hold a book while in an open position.

2. A collapsible book holder according to claim 1 wherein said open position comprises a triangular form.

3. A collapsible book holder according to claim 1 wherein said first and second angles are less than 45 degrees.

4. A collapsible book holder according to claim 1 wherein said third angle is about 180 degrees.

5. A collapsible book holder according to claim 1 wherein said open position comprises a triangular form wherein said first and second angle are less than 45 degrees, said fourth angle is greater than 90 degrees, and said third angle is about 180 degrees.

6. A collapsible book holder according to claim 1 wherein said first and second side connectors are hinges.

7. A collapsible book holder according to claim 1 wherein long leg connector comprises a double joint hinge.

8. A collapsible book holder according to claim 1 wherein at least one of said long leg connector and short leg connector is adapted to hold its position when in said open position.

9. A collapsible book holder according to claim 1 wherein said legs comprise a material selected from the group consisting of wood, bamboo, metal, composite and plastic materials.

10. A collapsible book holder according to claim 1 wherein each of said long legs each additionally comprise a compressible material attached thereto and extending respectively toward said short legs.

11. A collapsible book holder according to claim 1 wherein each of said long legs each additionally comprise a member attached so as to be reversibly extended respectively toward said short legs.

12. A collapsible book holder according to claim 1 wherein each of said long legs each additionally comprise a flexible member having two ends, one end fixed to said respective leg and the other end slideably attached to said respective leg, so as to be reversibly bowed toward and away from said short legs.

13. A collapsible book holder according to claim 1 wherein each of said long legs is each additionally comprised of a flexible, springy or spring-loaded member having two ends, one end attached to said respective leg, so as to reversibly spring toward and away from said short legs.

14. A collapsible book holder according to claim 1 additionally comprised of an attached illuminating lamp.

15. A collapsible book holder according to claim 1 wherein said long leg connector is additionally comprised of an attached illuminating lamp.

16. A collapsible book holder according to claim 1 wherein the first and second side connectors or hinges are adapted with springs to draw the first short leg to a position substantially alongside the first long leg and the second short leg to a position substantially alongside the second long leg.

* * * * *